US005374051A

United States Patent [19]

Ulrich et al.

[11] Patent Number: 5,374,051

[45] Date of Patent: Dec. 20, 1994

[54] RELIEF DEVICE FOR OFFSET STACKER TAMPING MECHANISM

[75] Inventors: Vernon W. Ulrich, Fairport; Carl B. Lewis, Webster, both of N.Y.

[73] Assignee: Xerox Corporation, Stamford, Conn.

[21] Appl. No.: 51,905

[22] Filed: Apr. 21, 1993

[51] Int. Cl.[5] ..... B65H 31/36

[52] U.S. Cl. ..... 271/222; 271/221

[58] Field of Search ..... 271/222, 221, 220

[56] References Cited

U.S. PATENT DOCUMENTS

| | | | |
|---|---|---|---|
| 3,385,457 | 5/1968 | Zinn | 271/222 X |
| 3,627,312 | 12/1971 | Fackler et al. | 271/221 |
| 4,147,342 | 4/1979 | Naramore | 271/221 |
| 4,318,541 | 3/1982 | Nagel et al. | 271/222 |
| 4,477,218 | 10/1984 | Bean | 271/221 X |
| 4,556,211 | 12/1985 | Carr | 271/221 |
| 4,568,172 | 2/1986 | Acquaviva | 355/14 SH |
| 5,058,880 | 10/1991 | McGraw et al. | 271/315 |
| 5,114,135 | 5/1992 | Evangelista et al. | 271/187 |
| 5,172,906 | 12/1992 | Dole | 271/215 |
| 5,188,353 | 2/1993 | Parks | 271/184 |

*Primary Examiner*—David H. Bollinger
*Attorney, Agent, or Firm*—Kevin R. Kepner

[57] ABSTRACT

A relief device for the tamping mechanism of an offset sheet set stacker. A sheet set stacker is provided having a plurality of retractable tamping mechanisms for alternately offsetting sheet sets within the stacker. Each tamping mechanism is provided with a spring biased follower arm which locks the tamping mechanism in an operative position. A relief device in the form of an oblong pivot mount allows the tamping mechanism to not only pivotally retract from an operative position but to also shift a slight amount transversely to the paper path process direction. This slight shift prevents a binding of the tamper against the just compiled sheet stack and minimizes the occurrence of sheet stack disturbance.

16 Claims, 5 Drawing Sheets

RELIEF DEVICE FOR OFFSET STACKER TAMPING MECHANISM

This invention relates generally to an apparatus for offset stacking of sheet sets, and more particularly concerns a relief device to prevent the jamming of the tamping mechanism of the stacking apparatus and disturbance of the stacked sheet sets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles* are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, particularly for the faster and more sophisticated electrophotographic printing machines now available, it is increasingly desirable to provide an effective device for stacking compiled sets of copied materials in any manner so that each set is offset from one to the next so an operator may easily differentiate between the individual sheet sets. It is further desirable to provide such an offsetting device so that it can function efficiently without disturbing previously compiled and offset sets of sheets.

The following disclosures may be relevant to various aspects of the present invention:

U.S. Pat. No. 5,188,353
Patentee: Parks
Issue Date: Feb. 3, 1993
U.S. Pat. No. 5,172,906
Patentee: Dole
Issue Date: Dec. 22, 1992
U.S. Pat. No. 5,114,135
Patentee: Evangelista et al.
Issue Date: May 19, 1992
U.S. Pat. No. 5,058,880
Patentee: McGraw et al.
Issue Date: Oct. 22, 1991
U.S. Pat. No. 4,568,172
Patentee: Acquaviva
Issue Date: Feb. 4, 1986
U.S. Pat. No. 4,318,541
Patentee: Nagel et al.
Issue Date: Mar. 9, 1982
U.S. Pat. No. 4,147,342
Patentee: Naramore
Issue Date: Apr. 3, 1979
U.S. Pat. No. 4,556,211
Patentee: Carr
Issue Date: Dec. 3, 1985

The relevant portions of the foregoing disclosures may be briefly summarized as follows:

U.S. Pat. No. 5,188,353 discloses a disk stacker having a tampering mechanism located over a sheet-receiving platform. First and second registration walls are provided, each wall having a tamper located adjacent to the wall and movable through an aperture therein. The tamper has an active position and inactive position and the tamper on each side registration wall operate alternately to offset stacks from one side to the other as each sheet set is discharged to the stacker.

U.S. Pat. No. 5,172,906 discloses a two-corner containing for receiving copy sheets for stacking and allows viewing of the stacking process within the machine as well as the status of the container outside the machine.

U.S. Pat. No. 5,114,135 discloses a registration assist device which presses the sheet located in the slot of the disk against the surface of the disk for a time period which begins to run prior to and extends until just after the time when a leading edge of the sheet contacts a registration wail which strips the sheets from the disk slot.

U.S. Pat. No. 5,058,880 discloses a disk stacker with a wiping member which moves in time relation to the disk. Preferably, the wiping member has a length sufficient to extend beyond the diameter of the .disk so it contacts the uppermost sheet on a stack, and re-register it against a front-registration wall if it has bounced away from.

U.S. Pat. No. 4,568,172 discloses a method of apparatus of more efficiently copying sets of document sheets having a small number of document sheets per set on a copier with a recirculating document handler and also includes a finishing device which stacks the set in an offset manner.

U.S. Pat. No. 4,318,541 discloses a device for positioning sheets in a stack in a sheet processing machine which has two joggers located at lateral sides of the stack, each jogger is operated by the use of an oscillating plate having a horizontal arm and a vertical arm, which upon activation, causes an oscillation of the vertical arm to align a stack.

U.S. Pat. No. 4,147,342 discloses a sheet stacking device utilizing a vibrating tamper.

U.S. Pat. No. 4,556,211 discloses a sheet stacking registration apparatus in which a jogging finger is slideable along an arm, which is mounted for a movement about a pivot access between a lower position and a raised position relatively adjacent sheets registered. The arm and jogging finger are normally resiliently biased away from a stack and upon activation are brought into a position against the stack to register and tamp the sheet stack.

In accordance with one aspect of the present invention, there is provided an apparatus for preventing sheet stack disturbance in a sheet stacker. The apparatus comprises a first registration member defining an aperture therein and a second registration member opposed from the first the registration member. There is also provided a first tamping mechanism located adjacent the first registration member, adapted to be movable through the aperture defined in the first registration member, the first tamping mechanism being movable between an inactive position located within the first registration member and an active position extending beyond the first registration member, the first tamping mechanism being adapted to oscillate, in the active position to tamp incoming sheets against the second registration member. There is also first means for relieving a force exerted on the first tamping mechanism by a sheet stack formed within the sheet stacker.

Pursuant to another aspect of the present invention, there is provided an electrophotographic printing machine of the type having a stacking device in which sets of sheets are stacked alternately offset from one another in a cross process direction, the stacking device having an apparatus to prevent sheet stack disturbance. The apparatus comprises a first registration member defining an aperture therein and a second registration member opposed from the first registration member. There is also provided a first tamping mechanism located adjacent the first registration member, adapted to be movable through the aperture defined in the first registration member, the first tamping mechanism being movable between an inactive position located within the first registration member and an active position extending beyond the first registration member, the first tamping mechanism being adapted to oscillate, in the active position to tamp incoming sheets against the second registration member. There is also first means for relieving a force exerted on the first tamping mechanism by a sheet stack formed within the sheet stacker.

Other features of the present invention will become apparent as the following description proceeds and upon reference to the drawings, in which.

Figure 4:
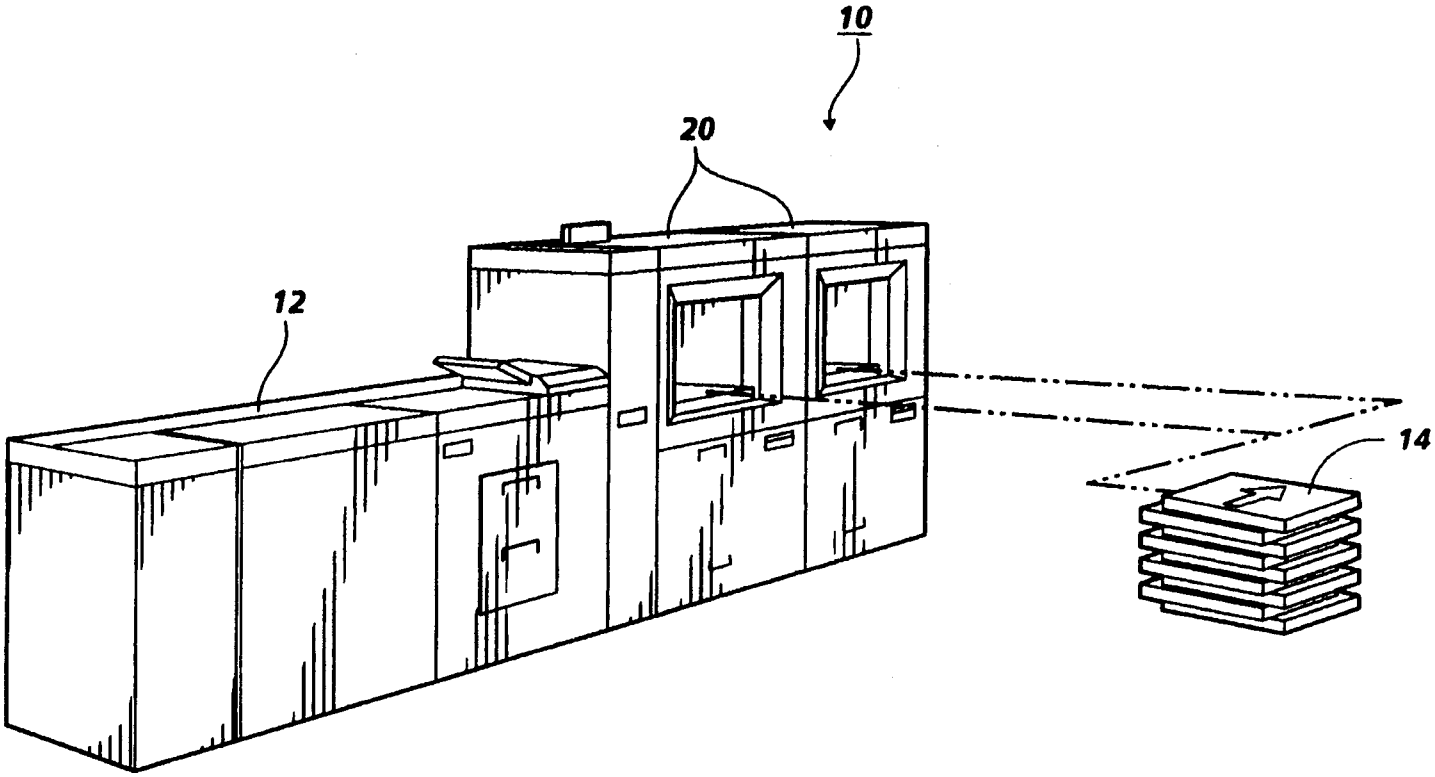
Figure 5:
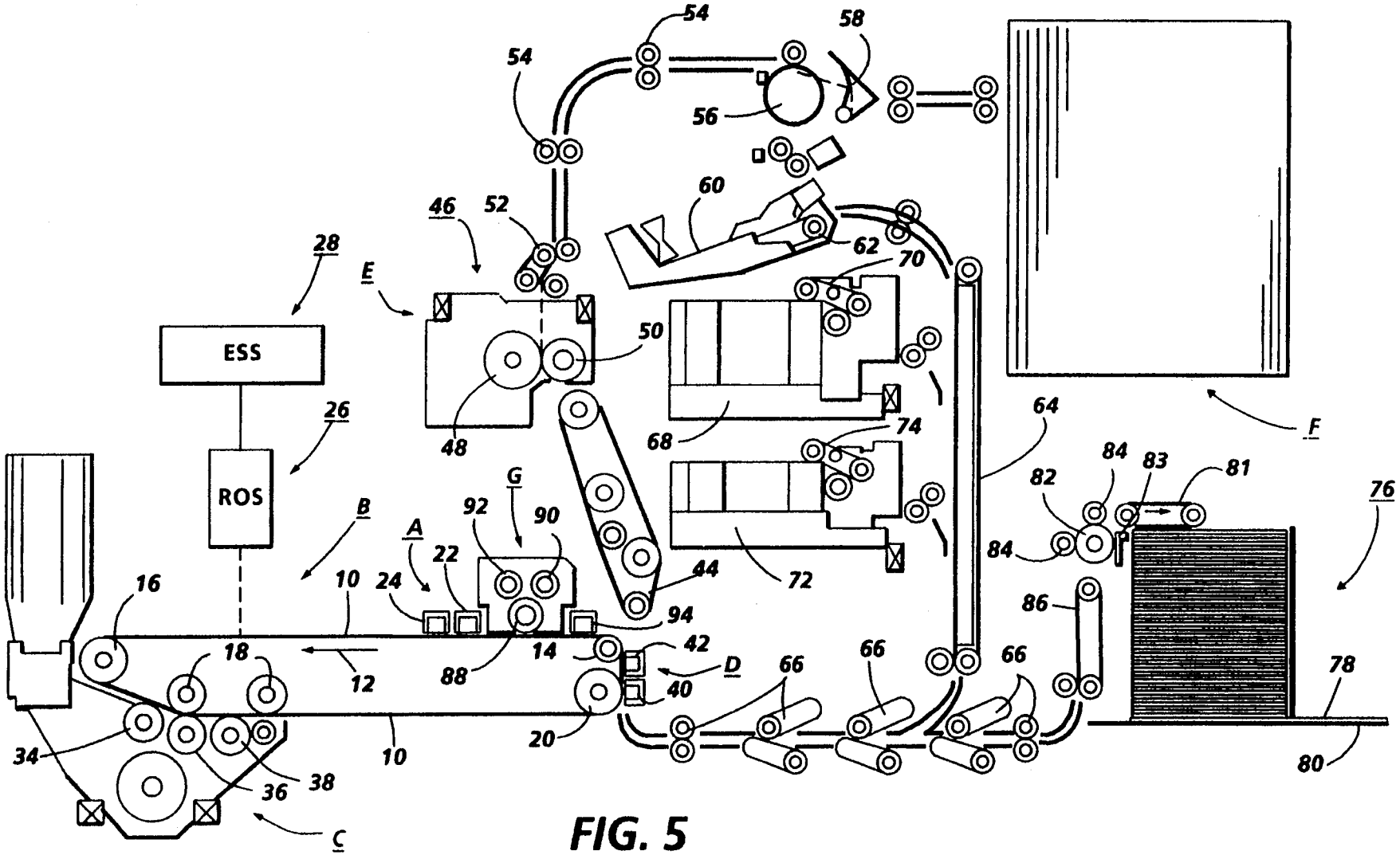

FIG. 4 is a perspective view of a printing machine and document outputting device which incorporates two disk stackers according to the present invention and also illustrates a stack of copy output compiled by one of the stackers in which individual sets of copies are offset from one another in the cross-process direction; and FIG. 5 is a schematic elevational view of the FIG. 4 printing machine incorporating the features of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 4 depicts a typical document output device 100 incorporating two disk stackers 120. It will become evident from the following discussion that the relief mechanism of the present invention may be employed in a wide variety of devices and it's not specifically limited in its application to the particular embodiment depicted herein.

Referring initially to FIG. 5 of the drawings, the electrophotographic printing machine employs a photoconductive belt 10. Preferably, the photoconductive belt is made from a photoconductive material coated on a ground layer, which, in turn, is coated on any anti-curl backing layer. The photoconductive material is made from a transport layer coated on selenium generator layer. The transport layer transports positive charges from the generator layer. The generator layer is coated on an interface layer. The interface layer is coated on a ground layer made from a titanium coated Mylar. The interface layer aids in the transfer of electrons to the ground layer. The ground layer is very thin and allows light to pass therethrough. Other suitable photoconductive materials, ground layers and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roller 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all the required charge on photoconductive belt 10. Corona generating device 24 acts as leveling device and fills in any areas missed by corona generating device 22. Next, the charged portion of the photoconductive surface is advanced through imaging station B.

At imaging station B, a raster output scanner (ROS), indicated generally by the reference numeral 26, discharges selectively those portions of the charge corresponding to the image portions of the document to be reproduced. In this way, an electrostatic latent image is recorded on the photoconductive surface. An electronic subsystem (ESS), indicated generally by the reference numeral 28, controls ROS 26. ESS 28 is adapted to receive signals from a computer and transpose these signals into suitable signals for controlling ROS 26 so as to record an electrostatic latent image corresponding to the document to be reproduced by the printing machine. ROS 26 may include a laser with a rotating polygon mirror block. The ROS 26 illuminates the charged portion of the photoconductive surface at a rate of about 600 pixels per inch. In this way, a raster electrostatic latent image is recorded on the photoconductive surface which corresponds to the desired information to be printed on the sheet. After the raster electrostatic latent image is recorded on the photoconductive surface, the photoconductive belt 10 rotates the raster electrostatic latent image to development station C.

At development station C, three magnetic brush developer rolls, indicated generally by the reference numerals 34, 36 and 38, develop the electrostatic latent image. A paddle wheel picks up developer material and delivers it to the developer rolls. When developer material reaches rolls 34 and 36, it is magnetically split between the rolls with half of the developer material being delivered to each roll. Photoconductive belt 10 is partially wrapped around rolls 34 and 36 to form an extended development zone. Developer roll 38 is a clean-up roll. A magnetic roller, positioned after developer roll 38 in the direction of arrow 12, is a carrier granular removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pretransfer light from a lamp (not shown) to reduce the attraction between photoconductive belt and the toner powder image. Next, a corona generating device 40 charges the copy sheet to the proper magnitude and polarity so that the copy sheet is tacked to photoconductive belt 10 and the toner powder image attracted from photoconductive belt 10 to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally be the reference numeral 46, which permanently affixes the transferred toner powder image to the copy sheet. Preferably, fuser assembly 46 includes a heated fuser roll 48 and pressure roll 50 with the powder image on the copy sheet contacting fuser roll 48. The pressure roll is cammed against the fuser roll to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfer to a donor roll and then to the fuser roll.

After fusing, the copy sheet are fed through a decurler 52. Decurler 52 bends the copy sheets in one direction to a put a known curl in the copy sheet and then bends it in the opposite direction to remove the material.

Forwarding rollers 54 then advance the sheet to duplex turn roll 56. Duplex solenoid gate 58 guides the sheet to the finishing station or to duplex tray 60. At finishing station F, copy sheets are stacked in a compiler tray and attached to one another to form set. The sheets are attached to one another either by a binding device or stapling device. In either case, a plurality of documents are formed in finishing station F. One duplex solenoid gate 58 diverts the sheet into duplex tray 60, duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are being reproduced.

In order to complete duplex copying, the simplex sheets in tray 60 are fed, in seriatim, by bottom feeder 62 from tray 60 back to transfer station D via conveyor 64 and roller 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 66. Secondary tray 66 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to roll 66 and then to transfer station D.

Copy sheets may also be fed to transfer station D from auxiliary tray 72. The auxiliary tray 72 includes an elevator driven by a bidirectional motor. Its controller has the ability to drive the tray up or down. When the tray is in the down position, stacks of copy sheets are loaded thereon or unloaded therefrom. In the up position, successive copy sheets are fed therefrom by sheet feeder 74. Sheet feeder 74 is a friction retard feeder utilizing a feed belt and take-away rolls to advance successive copy sheets to transport 64 which advances the sheets to roll 66 and then to transfer station D.

Secondary tray 68 and auxiliary tray 72 are secondary sources of copy sheets. A high capacity feeder, indicated generally by the reference numeral 76 is the primary source of copy sheets. High capacity feeder 76 includes a tray 78 supported on a elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to a take-away drive roll 82 and idler rollers 84. The drive roll and idler rollers guide the sheet onto transport 86. Transport 86 advances the sheet to roll 66 which, in turn, move the sheet to transfer station D.

Secondary tray 68, auxiliary tray 72, and high capacity feeder 76 all have associated therewith a stack height sensor. The stack height sensor determines when the stack sheets are positioned closely adjacent to the sheet feeder. Thus, the stack height sensor controls the movement of the tray in a vertical direction relative to the sheet feeder. As successive sheets are advanced from the stack disposed on the respective tray, the stack height sensor detects the absence of sheets adjacent the sheet feeder and regulates a motor for advancing the tray upwardly to position the next successive topmost sheet of the stack adjacent the sheet feeder. In this way, successive topmost sheets are advanced from the respective stack of sheets by the corresponding sheet feeder. The stack height sensor of the present invention will be shown only with reference to high capacity feeder 76. However, one skilled in the art will appreciate that the stack height sensor may be used under any circumstance in which if necessary to determine the absence or presence of a sheet at a selected location.

With continued reference to FIG. 5, after the copy sheet is separated from the photoconductive belt, residual toner particles invariably remain thereon. After transfer, photoconductive belt 10 passes beneath corona generating device 94 which charges the residual toner particles to the proper polarity. Thereafter, a precharge erase lamp (not shown) located inside photoconductive belt 10 discharges the photoconductive belt in preparation for the next successive imaging cycle. Residual particles are removed from the photoconductive surface at cleaning station G. Cleaning station G includes an electrically biased cleaner brush 88 and detoning rolls 90 and 92, i.e. waste and reclaim detoning rolls. The reclaim roll is electrically biased negatively relative to the cleaner roll so as to remove toner particles therefrom. The waste roll is electrically biased positively relative to the reclaim rolls so as to remove paper, debris and wrong sign toner particles. The toner particles on the reclaim roll are scraped off and deposited in a reclaim auger (not shown), where it is transported out of the rear of cleaning station G.

Figure 1:
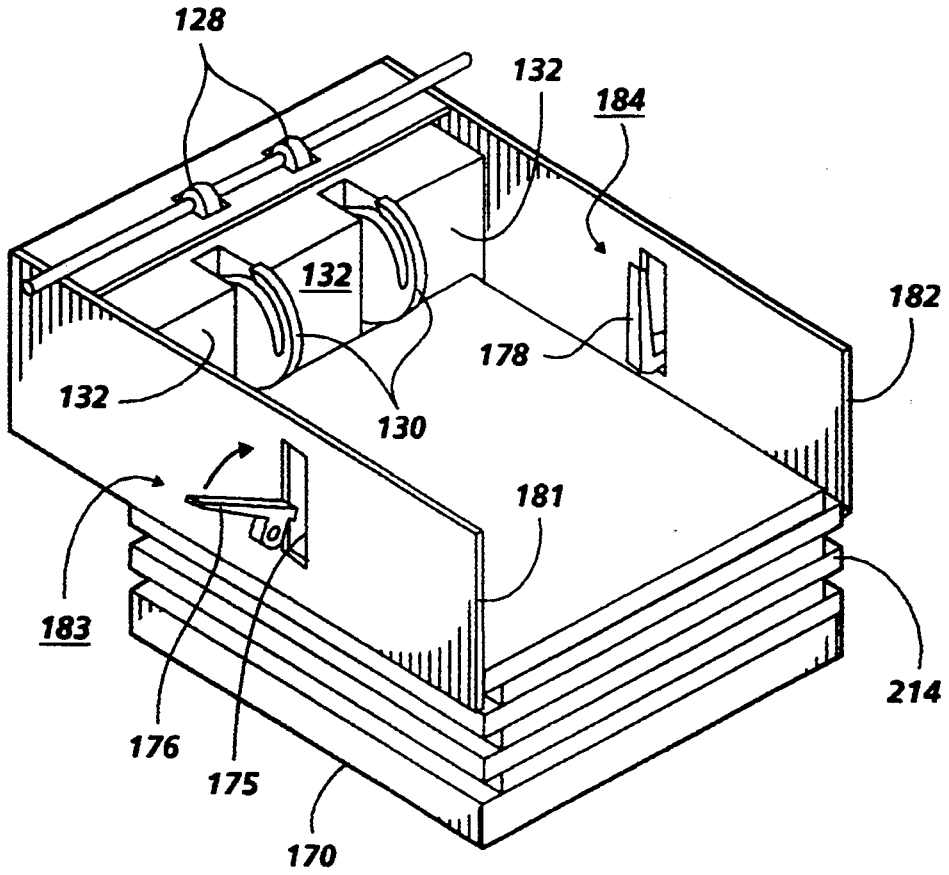
FIG. 1 is a schematic perspective view of a stacking tray incorporating first and second tampers which can be used as the cross direction offsetting mechanism incorporating the present invention, wherein one of the tampers is illustrated in an active position and the other tamper is shown in an inactive position behind its side registration wall.

Turning to FIG. 1, illustrating a stacking tray, the area of the stacker which receives inverted sheets from rotatable disks, includes a pair of side registration walls 183, 184 against which side edges of the sheets 214 are registered; in addition to elevator platforms 70; a registration wall 132 which contacts the lead edge of a sheet; and a trail-edge guide (not shown) which contacts the trail-edge of a sheet. Side registration wails 183, 184 can be fixed relatively to front registration wall or laterally movable, so that sheets having a variety of widths can be located between side registration walls 183, 184. The tamping mechanism 176, 178 is provided to tamp sheets against one of the side registration walls so that the side edges of all the sheets of a set are appropriately aligned.

The present invention provides a tamping mechanism which is capable of tamping the side edges of different sheets against one or the other of the side registration walls so that the sets of sheets can be offset from one another in a direction transverse to the process direction. The tamping mechanism includes first and second tampers respectively, each of which includes a tamping finger respectively. Each side registration wall can have more than one tamper. Each tamper moves through an aperture located in the first and second registration walls respectively, between an active position wherein the tamper is extended through its respective registration wall aperture and located above a surface of the sheet stack to tamp incoming sheets against the opposite side registration wall, and an inactive position wherein the tamper is retracted behind its respective registration wall out of the area between the first and second registration walls.

Figure 2A:
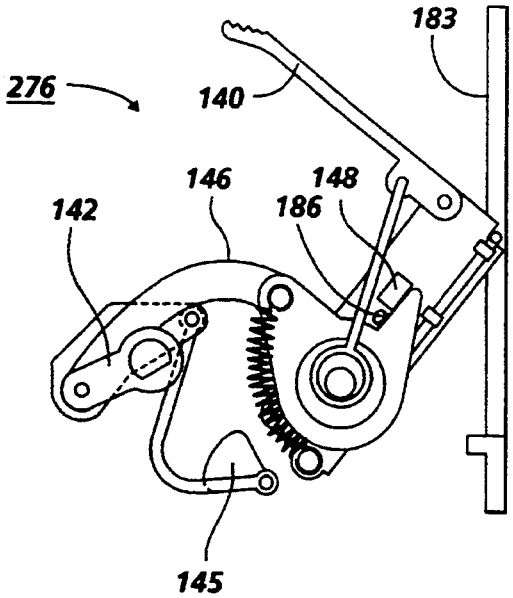
FIG. 2A PRIOR ART
FIGS. 2A, 2B and 2C illustrate a prior art tamping mechanism in the retracted, partially extended, and fully extended tamping positions, respectively.
Figure 2B:
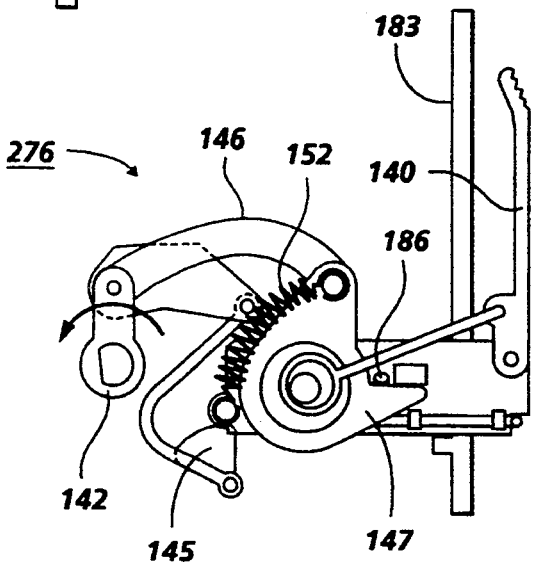
FIG. 2B PRIOR ART
Figure 2C:
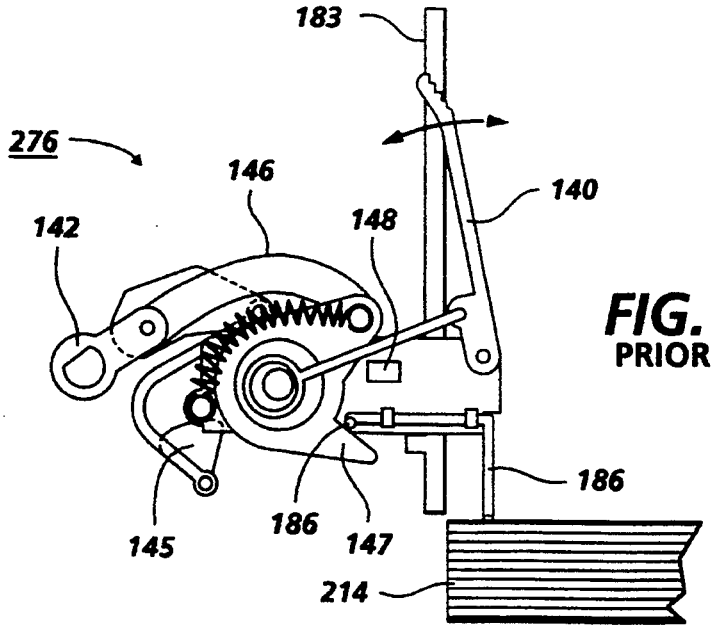
FIG. 2C PRIOR ART

Turning next to FIGS. 2A through 2C, the tamping mechanism 276 of the prior art is illustrated. As seen in FIG. 2A, initially the tamper is in retracted position behind the registration wall 183. Upon rotation of input crank 142, the tamper finger 140 is rotated as a result of the connecting linkage through an aperture 175 (FIG. 1) in the registration wall 183 to a position adjacent the sheet stack 214. A wire bail 186 arrangement is rotated down upon the top of the tray bottom surface or previously stacked sheet sets 214 to provide a registration guide. The input crank 142 rotation is then stopped by use of a clutch (not shown), and the tamping arm 140 is oscillated back and forth in a horizontal direction so that each incoming sheet is registered against the opposing registration wall. A locking mechanism 145 including a link and cam is connected in common with crank 142 to prevent the tamping mechanism 148 from shifting while in the operative position. Once the set of sheets is fully registered, the tamper mechanism 276 must then be retracted back into the registration wall 183. In the illustrated embodiment of the prior art, as a result of the connecting linkages 145, 146, 147 and the necessity for all of the pivot points to be fixed, the wire bail 186 is often wedged against the sheet stack 214. The force exerted against the wire bail 186 by the sheet stack 214 often inhibits the retraction of the tamping mechanism 148 back into the registration wall or causes a jerking motion which disturbs the just registered and offset stack of sheets. The detailed operation of this mechanism is described in U.S. Pat. No. 5,188,353 commonly assigned to the assignee herein, the relevant portions of which are herein incorporated by reference.

Figure 3A:
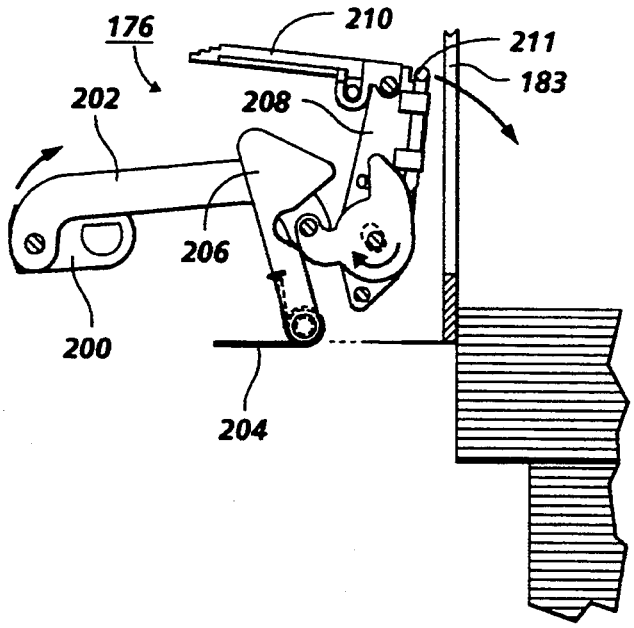
FIGS. 3A, 3B and 3C illustrate a tamping mechanism utilizing the jam-prevention device of the present invention in the retracted, extended, and relief positions, respectively.
Figure 3B:
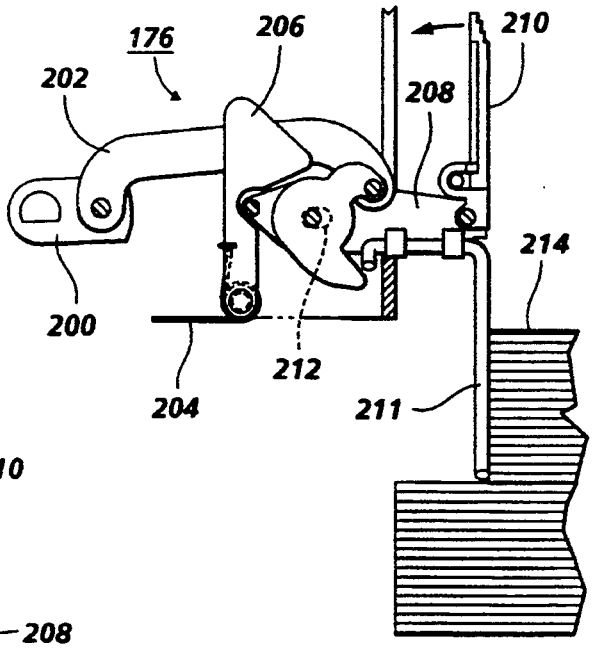
Figure 3C:
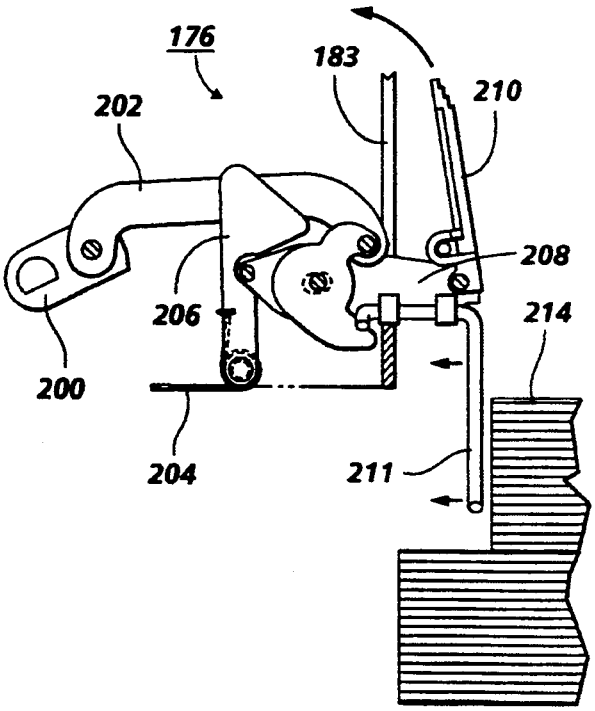

Referring now to FIGS. 3A through 3C, the tamping mechanism 176 including the relief mechanism of the present invention is illustrated. FIG. 3A illustrates the tamping mechanism 176 in the retracted position. Referring next to 3B it can be seen as the input crank 200 is rotated the tamping arm assembly 208 is caused to be extended through the registration wall 183 and into an active position by means of the connecting link 202. A spring 204 biases a follower arm 206 riding against the tamping arm assembly 208 and causes the tamping finger 210 to be locked in an active position when a lug on the tamping arm assembly 208 meshes with a detent in the follower 206. This assures that all of the sheets of the set being tamped are registered fully against the opposing registration wall. Once each set is fully compiled and registered, the input crank 200 is again rotated and the tamping mechanism 208 is retracted into the registration wall 183. Should the wire bail 211 be wedged against the sheet stack 214 as previously described, the illustrative mechanism provides for a slight movement away from the sheet stack, as seen in FIG. 3C, by the wire bail 211 and tamping arm assembly 208 prior to retracting the arm. This slight movement is provided as a result of the elongated pivot mount 212 in the tamping arm assembly 208 and the spring biased follower assembly 206. The force of the stack 214 causes the tamping arm assembly 208 to be moved away from the stack 214 against the spring force of the follower 206. As the follower 206 is independently movable in a direction away from the stack 214 the tamping arm assembly 208 is not hindered as it is retracted into the inactive position. This slight movement in the cross-process direction relieves the pressure against the wire bail 211 and allows for retraction of the tamping mechanism 208 into the registration wall 183 without disturbance of the compiled sheet set 214 in the stacker.

In recapitulation, there is provided a relief device for a sheet stacker which prevents the disruption of the stacked and offset sets of sheets in the stacking apparatus. The relief device includes a spring-biased follower mechanism on the individual set tamping mechanism, used to lock the tamper in the operative position, and an elongated pivot point which allows the tamping mechanism to pull away slightly from a just compiled set of sheets prior to retracting. This improvement allows the tamping mechanism to accurately align and offset alternate sets of sheets and to retract within the registration wall without upsetting the just registered sheet stack.

It is, therefore, apparent that there has been provided in accordance with the present invention, a relief device for a tamping mechanism that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for preventing sheet stack disturbance in a sheet stacker, comprising:

a first registration member having an aperture therein;

a second registration member opposed from said first registration member;

a first tamping mechanism located adjacent said first registration member adapted to be movable through the aperture in said first registration member, said first tamping mechanism being movable between an inactive position located within said first registration member and an active position extending beyond said first registration member, said first tamping mechanism being oscillated, in the active position, to tamp incoming sheets against the second registration member; and first means for relieving a force exerted on said first tamping mechanism by a sheet stack formed within the sheet stacker.

2. An apparatus according to claim 1 further comprising means for moving said first tamping mechanism between the inactive and active positions.

3. An apparatus for preventing sheet stack disturbance in a sheet stacker, comprising:

a first registration member having an aperture therein;

a second registration member opposed from said first said registration member;

a first tamping mechanism located adjacent said first registration member adapted to be movable through the aperture in said first registration member, said first tamping mechanism being movable between an inactive position located within said first registration member and an active position extending beyond said first registration member, said first tamping mechanism being adapted to oscillate, in the active position, to tamp incoming sheets against the second registration member; and first means for relieving a force exerted on said first mechanism by a sheet stack formed within the sheet stacker;

means for moving said first tamping mechanism inactive and active positions;

a second tamping mechanism located adjacent said second registration member, said second registration member having an aperture therein, said second tamping mechanism being movable between an inactive position located within said second registration member and an active position extending beyond said second registration member, said second tamping mechanism being adapted to oscillate, in the active position, to tamp incoming sheets against the first registration member; and second means for relieving a force exerted on said second tamping mechanism by a sheet stack formed within the stacker.

4. An apparatus according to claim 3 further comprising means for moving said second tamping mechanism between the inactive and active positions.

5. An apparatus according to claim 4, comprising means to lock said first and said second tamping mechanisms in the active position.

6. An apparatus according to claim 5, wherein said locking means comprises:

a first follower member adapted to contact said first tamping mechanism, said first follower member defining a detent therein and said first tamping mechanism having a lug thereon, said lug meshing with the detent in response to said first tamping mechanism being in the active tamping position;

means for biasing said first follower member against said first tamping mechanism;

a second follower member adapted to contact said second tamping mechanism, said second follower member defining a detent therein and said second tamping mechanism having a lug thereon, said lug meshing with the detent in response to said second tamping mechanism being in the active tamping position; and means for biasing said second follower member against said second tamping mechanism.

7. An apparatus according to claim 3, wherein said first tamping mechanism comprises:

a first tamping finger; and a first tamping base member pivotally connected at a first end to said first tamping finger and pivotally connected at a second end to said first registration member so as to be retractable through the aperture therein, said base member defining an elongated pivot mount so as to be moveable in a direction transverse to the process direction to relieve force on the stack as well as pivotally.

8. An apparatus according to claim 3, wherein said second tamping mechanism comprises:

a second tamping member; and a second tamping base member pivotally connected at a first end to said second tamping member and pivotally connected at a second end to said second registration member so as to be retractable through the aperture therein from an active to an inactive position, said base member defining an elongated pivot mount at the second end so as to be moveable in a direction transverse to the process direction to relieve force on the stack as well as pivotally.

9. An electrophotographic printing machine of the type having a stacking device in which sets of sheets are stacked alternately offset from one another in a cross-process direction, the stacking device having an apparatus to prevent sheet stack disturbance, comprising:

a first registration member having an aperture therein;

a second registration member opposed from said first said registration member;

a first tamping mechanism located adjacent said first registration member adapted to be movable through the aperture in said first registration member, said first tamping mechanism being movable between an inactive position located within said first registration member and an active position extending beyond said first registration member, said first tamping mechanism being oscillated, in the active position, to tamp incoming sheets against the second registration member; and first means for relieving a force exerted on said first tamping mechanism by a sheet stack formed within the sheet stacker.

10. A printing machine according to claim 9 further comprising means for moving said first tamping mechanism between the inactive and active positions.

11. An electrophotographic printing machine of the type having a stacking device in which sets of sheets are stacked alternately offset from one another in a cross-process direction, the stacking device having an apparatus to prevent sheet stack disturbance, comprising:

a first registration member having an aperture therein;

a second registration member opposed from said first said registration member;

a first tamping mechanism located adjacent said first registration member adapted to be movable through the aperture in said first registration member, said first tamping mechanism being movable between an inactive position located within said first registration member and an active position extending beyond said first registration member, said first tamping mechanism being adapted to oscillate, in the active position, to tamp incoming sheets against the second registration member; and first means for relieving a force exerted on said first tamping mechanism by a sheet stack formed within the sheet stacker;

means for moving said first tamping mechanism between the inactive and active positions;

a second tamping mechanism located adjacent said second registration member, said second registration member having an aperture therein, said second tamping mechanism being movable between an inactive position located within said second registration member and an active position extending beyond said second registration member, said second tamping mechanism being adapted to oscillate, in the active position, to tamp incoming sheets against the first registration member; and second means for relieving a force exerted on said second tamping mechanism by a sheet stack formed within the stacker.

12. An apparatus according to claim 11 further comprising means for moving said second tamping mechanism between the inactive and active positions.

13. A printing machine according to claim 12 comprising meads to lock said first and said second tamping mechanisms in the active position.

14. A printing machine according to claim 13, wherein said locking means comprises:

a first follower member adapted to contact said first tamping mechanism, said first follower member defining a detent therein and said first tamping mechanism having a lug thereon, said lug meshing with the detent in response to said first tamping mechanism being in the active tamping position;

means for biasing said first follower member against said first tamping mechanism;

a second follower member adapted to contact said second tamping mechanism, said second follower member defining a detent therein and said second tamping mechanism having a lug thereon, said lug meshing with the detent in response to said second tamping mechanism being in the active tamping position; and means for biasing said second follower member against said second tamping mechanism.

15. A printing machine according to claim 11, wherein said first tamping mechanism comprises:

a first tamping finger; and a first tamping base member, said base member pivotally connected at a first end to an end of said first tamping finger, said base member pivotally connected at a second end to said first registration member so as to be retractable through the aperture therein, said base member defining an elongated pivot mount so as to be moveable in a direction transverse to the process direction to relieve force on the stack as well as pivotally.

16. A printing machine according to claim 11, wherein said second tamping mechanism comprises:

a second tamping member; and a second tamping base member, said base member pivotally connected at a first end to an end of said second tamping member, said base member pivotally connected at a second end to said second registration member so as to be retractable through the aperture therein from an active to an inactive position, said base member defining an elongated pivot mount at the second end so as to be moveable in a direction transverse to the process direction to relieve force on the stack as well as pivotally.

* * * * *